US005425256A

United States Patent [19]

Crosby

[11] Patent Number: 5,425,256

[45] Date of Patent: Jun. 20, 1995

[54] DOOR KNOB SECURITY DEVICE

[76] Inventor: Theodore M. Crosby, 375 Glen Oaks Rd., Venice, Fla. 34293

[21] Appl. No.: 254,905

[22] Filed: Jun. 6, 1994

[51] Int. Cl.[6] ..... E05B 17/14

[52] U.S. Cl. ..... 70/209; 292/DIG. 2; 70/212; 70/163; 70/165

[58] Field of Search ..... 70/209–211, 70/428, 207, 212, 232, 416, 417, 423, 158, 163, 164, 166; 292/DIG. 2

[56] References Cited

U.S. PATENT DOCUMENTS

| | | | |
|---|---|---|---|
| 3,181,523 | 5/1965 | Casey | 70/232 |
| 3,739,608 | 6/1973 | Young | 70/209 |
| 3,952,564 | 4/1976 | Maines | 70/232 X |
| 4,069,692 | 1/1978 | Hemphill | 70/212 X |
| 4,570,470 | 2/1986 | Gray, Sr. | 70/212 X |
| 4,838,059 | 6/1989 | Johnson | 70/209 |
| 4,876,867 | 10/1989 | Leneave | 70/428 |
| 4,899,564 | 2/1990 | Gilbert | 70/428 |
| 5,201,202 | 4/1993 | Kam | 70/428 X |

*Primary Examiner*—Peter M. Cuomo
*Assistant Examiner*—Monica E. Millner
*Attorney, Agent, or Firm*—Gifford, Krass, Groh, Sprinkle, Patmore, Anderson & Citkowski

[57] ABSTRACT

A security device for use with rotatable door knobs which incorporates a pair of generally cylindrical members positioned on a door knob and telescoped together to receive a padlock to prevent separation. The housing members rotate relative to each other and to the door knob to prevent actuation of the door knob and access to any keyed lock that may be incorporated in the knob.

8 Claims, 1 Drawing Sheet

DOOR KNOB SECURITY DEVICE

TITLE OF THE INVENTION

This invention relates to security devices and particularly a security device for preventing access and operation of a rotary door knob.

BACKGROUND OF THE INVENTION

The security of homes, offices and rooms of hotels and motels against unlawful entry is a major concern. Particularly, in the case of hotels, the security of a room is dependent on key and lock arrangements and the effectiveness is determined by how carefully keys to such locks have been controlled. Because of lost keys and the possibility of duplicating keys possession of keys to such room is uncertain.

Devices have been provided for adding security to established door knob installations which is under the control of the individual and may be used with selected doors. Among such devices are those for disabling the door knob and preventing access to the lock portion which frequently is incorporated in the knob. Unfortunately such devices tend to become complex to have multiple parts making it difficult to put the arrangement into operation and are easily tampered with and overcome so that the door knob is available for operation and unlocking.

It is an object of the invention to provide security device which is easily attachable to rotary type door knob to prevent operation of the door knob and access to the key and lock that may be incorporated in the door knob.

It is another object of the invention to provide a security device which can be easily installed on the door knob with one hand if necessary.

Another object of the invention is to provide such a security device which utilizes a minimum of simple parts.

Yet another object of the invention is to provide a security device which can be applied to doors which are not otherwise provided with locks.

The objects of the invention are attained by a security device for a rotatable door knob in which an inner body member has a generally cylindrical configuration including a pair of spaced end walls which are joined together in spaced apart relationship to receive a knob there between and an outer body member having a generally cylindrical configuration to receive the inner body member and door knob. The inner body member has a lock member protruding through and end wall of the outer body member to receive a lock device to prevent separation of the two body members and at the same time to permit relative rotation between the body members and relative to the door knob to prevent actuation of the door knob and also to prevent access to the key portion of the door knob.

These and other objects and advantages of the invention will become apparent from the following description taken together with the accompanied drawings.

DETAILED DESCRIPTION OF THE INVENTION

Figure 1:
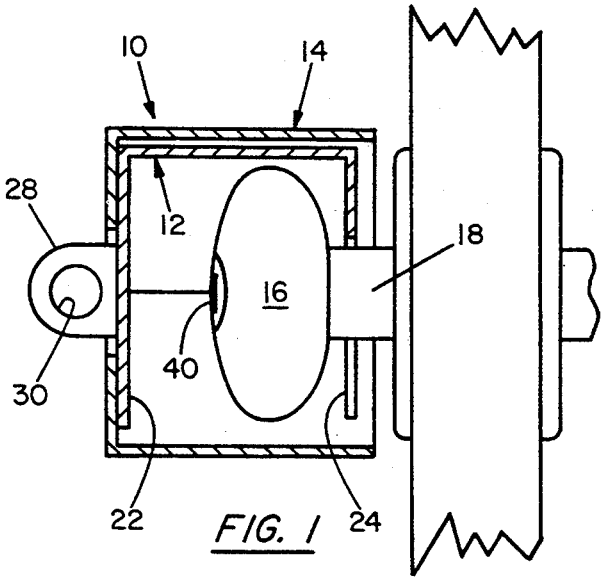
FIG. 1 is a cross-sectional view of the security device embodying the invention in position relative to a door knob of a door, only a portion of which is shown.
Figure 2:
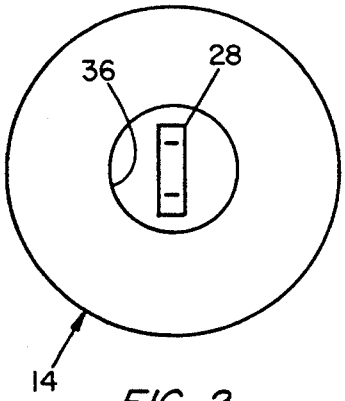
FIG. 2 is and end view of the security device taken from the left end of the security device shown in FIG. 1.

The security device embodying the present invention is designated generally 10 in FIG. 1 and includes an inner housing 12 and an outer housing 14 shown in their assembled condition in relationship to a door knob 16 which is rotatable and supported by a shaft 18 in spaced relationship to one side of a door 20. Typically, the opposite side of the door also is provided with a knob which is not shown, and which is capable of use with the security device 10.

The inner housing member 12 which is shown in FIGS. 1 and 5 through 7 has a generally cylindrical configuration and includes a circular or disc/shaped end wall 22 and a generally U-shaped end wall 24. The end walls 22 and 24 are held in spaced apart relationship by a semi-cylindrical wall 26 which is fixed to the end walls 22 and 24 by welding or the like. The end wall 22 also is provided with a lock means in the form of a lock member or tang 28 which protrudes from one end of the end wall 22 of inner housing member 12 generally along the axis of the cylindrical configuration of the inner housing 12. The tang 28 has a transverse opening 30 which is adapted to revive a lock, not shown.

Figure 3:
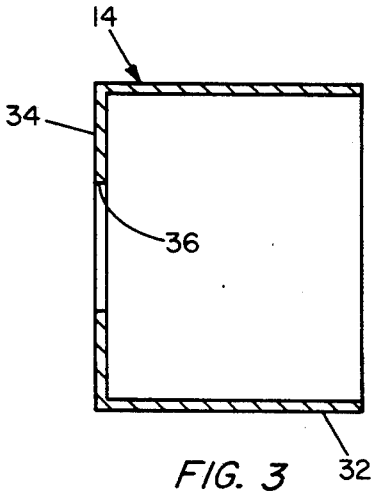
FIG. 3 is a cross-sectional view of the outer housing member.
Figure 4:
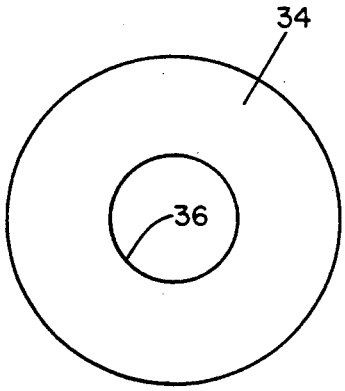
FIG. 4 is an end view of the outer housing member shown in FIG. 3.
Figure 6:
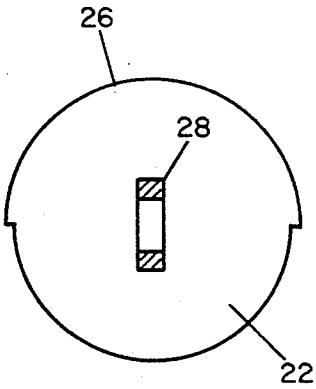
FIG. 6 is a cross-sectional view on line 6—6 in FIG. 5.
Figure 5:
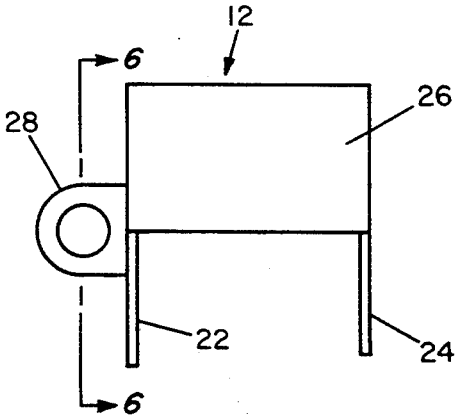
FIG. 5 is a sign elevation of the inner housing member shown separately from the door knob and outer housing member.
Figure 7:
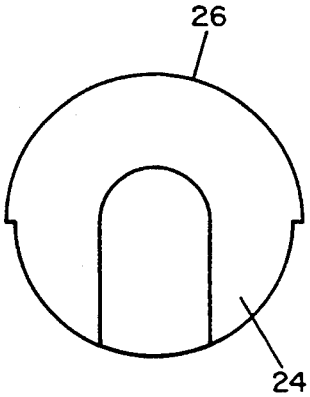
FIG. 7 is an end view taken from the right end if the inner housing member seen in FIG. 5.

The outer housing 14 is shown in FIGS. 1, 3 and 4 and has an outer cylindrical wall 32 partially closed at one end by an annular wall 34 which forms an axial opening 36.

As best seen in FIG. 1 the inner housing member 12 is shaped to telescope within the outer housing member 14 so that the lock member on tang 28 protrudes through the opening 36.

In operation, the inner housing member 12 is placed on the knob 16 so that the semi-cylindrical wall 26 rest on the top of the knob 16 with the legs of the U-shaped end wall straddling the shaft 18 between the knob 16 and the door so that the end walls 22 and 24 are in spaced apart relationship at axially opposite sides of the door knob 16. Thereafter, an outer housing member 14 is telescoped axially over the inner housing member 12 so that the tang 28 protrudes through the end wall 34 through the opening 36 in position to receive a lock device such as a padlock, not shown, in the opening 30. In that manner, the two housing members 12 and 14 are prevented from separating but at the same time the inner and outer housing members 12 and 14 are free to rotate relative to each other and the inner housing member 12 is free to rotate relative to the door knob 16.

In the position shown in FIG. 1, and with a padlock device through the opening 30 to prevent separation of the inner and outer housing members, actuation or rotation of the door knob 16 is prevented because of rotation of the outer housing member relative to the inner housing member. Furthermore, if an attempt is made to rotate the inner and outer members 12 and 14 as a unit, the two parts rotate relative to the knob 16 and prevent actuation. Also, axial removal of the security device 10 from the knob 16 is prevented by the U-shaped end wall 24 of the inner housing member 12 which engages the knob 16 to prevent such removal.

When not in use, the security device 10 is easily removed and the two housing members 12 and 14 can be telescoped together for compact storage as a unit in readiness for use.

A security device has been provided for use with rotatable door knobs which utilizes a pair of telescoping housing members that can be positioned relative to the door knob and locked together with readily available padlocks so that the housing members rotate relative to each other and to the door knob to prevent actuation of the door knob and also obstruct access to any keyed lock which may be incorporated in the knob.

Access to the U-shaped end wall 24 of the inner housing member is made difficult by insuring that the U-shaped end wall 24 is spaced from the open end of the outer housing member 14 so that prying or other tampering is discouraged. Whether or not the door knob 16 incorporates a lock device such as that indicated at 40 in FIG. 1, the security device 10 of the present invention offers security by disabling the door knob 16 from being able to be rotated to actuate the usual latch mechanism.

I claim:

1. A security device for a rotatable door knob having a shaft portion, the combination comprising:

a first body member having a pair of spaced walls disposed transversely of the axis of rotation of said knob to receive said knob therebetween to limit axial movement and permit rotation of said body member relative to said knob, a second body member having a cylindrical outer wall with an annular wall at one end and forming an opening at the other end to telescopically receive said first body member and said knob, and lock means on one end wall of said first body member coacting with said annular wall and preventing separation of said first and second body members and access to said door knob and permitting free rotation of said body members relative to each other and relative to said knob.

2. The combination of claim 1 wherein said lock means includes a lock member formed on one of said walls of said first body member and an opening formed by said second body member to receive said lock member.

3. The combination of claim 2 wherein said opening is disposed axially of the knob to receive said lock member and permit rotation relative thereto.

4. The combination of claim 2 wherein the other of said walls forms a slot to stradle said shaft portion and permit rotation relative thereto.

5. The combination of claim 2 wherein said lock member is positioned to the exterior of said second body member to receive a pad lock to prevent separation of said body members.

6. A security device for a rotatable door knob having a shaft portion, the combination comprising:

an inner body member having a generally cylindrical configuration including a pair of spaced end walls, said end walls being joined together in spaced apart relation by a semicylindrical wall, one of said end walls having a recess to receive said shaft portion when said knob is disposed between said pair of spaced end walls, a lock member formed on the other of said pair of end walls, and a cylindrical outer body member having a wall at one end and forming an opening at the other end to telescopically receive said inner body member, said wall of said outer body member forming an axially disposed aperture, said outer body member telescopically receiving said inner body member and knob therein with said lock member protruding through said aperture to permit free rotation of said body members relative to each other and relative to said knob in said inner body member, said lock member being exposed at the exterior of said cylindrical outer body member to receive a lock device to prevent separation of said body members.

7. The combination of claim 6 wherein said lock member has a radially extending opening to receive a lock device to prevent separation of said body members.

8. The combination of claim 6 wherein said semicylindrical wall is engageable with the top of a knob to support said inner body member during placement of said outer body member over said inner body member.

* * * * *